US006021625A

United States Patent [19]

Cerwin et al.

[11] Patent Number: 6,021,625

[45] Date of Patent: Feb. 8, 2000

[54] PROCESS FOR MICROBIAL BARRIER VENT TO A FOIL PACKAGE

[75] Inventors: Robert J. Cerwin, Pipersville, Pa.; Robert A. Daniele; Clifford Dey, both of Flemington, N.J.; J. Mark Findlay, San Angelo, Tex.; Konstantin Ivanov, Bound Brook, N.J.; Matthew E. Krever, New Brunswick, N.J.; Jervis P. Lynch, Iselin, N.J.; Robert Nunez, Asbury, N.J.; William R. Reinhardt, Belle Mead, N.J.; Mehmet Reyhan, E. Windsor, N.J.; David Szabo, Branchburg, N.J.; Manfred Reiser, Winnenden-Hertmannsweiler, Germany; Rolf Grotehusmann, Michelfeld, Germany; Manfred Hild, Schorndorf, Germany; Bernhard Frey, Backnang, Germany

[73] Assignee: Ethicon, Inc., Somerville, N.J.

[21] Appl. No.: 09/199,086

[22] Filed: Nov. 24, 1998

[51] Int. Cl.[7] ..... B65B 55/02

[52] U.S. Cl. ..... 53/425; 493/37; 493/16; 53/52; 53/53; 53/433; 53/453; 53/478; 53/415

[58] Field of Search ..... 73/45.4, 49.3, 73/52; 493/9, 16, 37; 53/52, 53, 64, 65, 77, 507, 508, 510, 511, 432, 433, 425, 453, 478, 415, 135.1, 135.2, 135.3, 136.1

[56] References Cited

U.S. PATENT DOCUMENTS

| | | | |
|---|---|---|---|
| 3,410,395 | 11/1968 | Sellers | 53/425 X |
| 3,708,949 | 1/1973 | Wilcox | 53/53 |
| 4,022,324 | 5/1977 | Schuster | 53/425 X |
| 5,577,364 | 11/1996 | Wang et al. | 53/53 |
| 5,623,810 | 4/1997 | Dey et al. | 53/425 |
| 5,868,244 | 2/1999 | Ivanov et al. | 53/425 X |
| 5,939,619 | 8/1999 | Achter et al. | 73/49.3 X |

*Primary Examiner*—Daniel B. Moon
*Attorney, Agent, or Firm*—Emil Richard Skula

[57] ABSTRACT

A process for applying a biobarrier member to a vent opening in a foil member used for medical device packaging. The process provides for cutting a biobarrier member from a roll of stock and sealing the biobarrier member about the vent opening in the foil member. The seal is tested for integrity and the biobarrier member is tested for porosity.

8 Claims, 11 Drawing Sheets

PROCESS FOR MICROBIAL BARRIER VENT TO A FOIL PACKAGE

TECHNICAL FIELD

The field of art to which this invention relates is packaging processes, in particular, processes for packaging medical devices.

BACKGROUND OF THE INVENTION

Packages for sterile medical devices, such as surgical sutures, are well known in the art. Processes for packaging sterile medical devices are similarly well known.

Surgical sutures are typically packaged in primary packages that prevent the sutures from being damaged during routine shipping, handling and storage. The primary packages containing the sutures are then packaged in conventional secondary packages that function as sterile barriers to maintain the sterility of the medical devices. These secondary packages are well known in the packaging arts. The type and structure of the secondary package utilized will depend upon a number of factors, including the type of medical device, the size and construction of the primary package, and the sterilization process utilized. There are a variety types of conventional sterilization processes which can be used for medical devices, including ethylene oxide gas, radiation, plasma and autoclaving.

Depending upon the type of medical device that is to be sterilized, one or more of these sterilization techniques may be utilized. For example, a medical device such as a suture made from an absorbable polymer may be sterilized in an ethylene oxide sterilization process, but may not be suitable for processing in a radiation sterilization process or an autoclaving process. The reason for this is that radiation or extreme heat may degrade the polymeric structure of the device, rendering it unusable during surgery or unsuitable for implantation into the patient's body. On the other hand, autoclaving or radiation may be more appropriate for a medical device made from a ceramic, a non-absorbable polymer, or a metal. In general, the choice of the type of secondary package will depend upon both the material of construction of the medical device and the type of sterilization process utilized.

In ethylene oxide gas sterilization, it is necessary to expose the medical device to both humidity and ethylene oxide gas for the process to work effectively. A conventional secondary package that is selected for a medical device subjected to an ethylene oxide gas sterilization process is known as a pouch or an envelope. Such pouches or envelopes typically consist of a sheet of a clear, gas impervious polymer film sealed about its periphery to a sheet of a gas pervious or gas penetrable polymer film such as TYVEK® spun-bonded polyethylene. The gas pervious film allows humidity and the sterilant gas to enter the pouch and thereby come into contact with the medical device (typically packaged within a primary package) contained within the sealed pouch. The gas pervious film also permits the sterilant gas and humidity to exit the pouch at the end of the sterilization cycle. After the sterilant gas is evacuated from the pouch, typically by the application of a vacuum, the interior of the pouch equilibrates with the ambient atmosphere via the gas pervious film.

For certain absorbable medical devices, prolonged exposure to ambient air, particularly humid air, during storage will cause the polymeric material to break down or degrade. It is often desirable to use ethylene oxide sterilization for such absorbable products since, as previously mentioned, radiation and autoclaving are unacceptable, but these absorbable products cannot be packaged in conventional gas sterilization pouches and stored and handled in a conventional manner.

In order to address this dilemma, special foil secondary packages have been developed for these devices. The foil packages when sealed provide a hermetically sealed enclosure that is substantially impervious to gases and moisture. The shelf life of the absorbable polymer device is extended since moisture infiltration into the hermetically sealed pouch is essentially eliminated. However, the use of ethylene gas sterilization processes with these types of foil pouches typically requires that the devices be sterilized with the pouch open on one end to allow the sterilant gas and humidity to access the interior of the pouch and contact the medical device. Different types of pouches and sterilization processes have been developed for these foil pouches. In one conventional process, the ends of the pouch are maintained in an open configuration during sterilization. After sterilization, the pouch is then maintained in an aseptic environment and aseptically sealed to provide for a hermetically sealed pouch having a sterile interior. Foil pouches or packages for absorbable sutures and a method of manufacturing the packages and packaging the sutures are disclosed in U.S. Pat. Nos. 5,623,810 and 5,709,067 which are incorporated by reference. A method of gas sterilizing absorbable sutures in open foil packages and then aseptically sealing the packages to produce hermetically sealed sterile enclosures is disclosed in U.S. Pat. No. 5,464,580 which is incorporated by reference. In other processes, the foil package may have a gas permeable header. After sterilization, the open end of the foil package is sealed adjacent to the header and the header is cut off. In another known process, the open foil pouch is sealed in a secondary package consisting of a conventional gas sterilization pouch. The open end of the foil pouch is sealed through the pouch after sterilization.

It is known that the aseptic sealing of sterile foil packages requires precise environmental controls and techniques including air filtering. These controls and techniques may be costly and difficult to implement and maintain. New foil packages and sterilization techniques have been developed which eliminate the need for aseptic sealing and processing. A multi-cavity secondary foil package having a gas permeable vent is disclosed in U.S. Pat. No. 5,868,244 which is incorporated by reference. In such a package, a medical device is loaded into each cavity. The vent is typically located interior to the periphery of the package, preferably centrally. This vented package is partially sealed prior to sterilization forming a gas tight peripheral seal and secondary seals such that the secondary seals form channels. The channels form a gaseous pathway between each medical device and the central vent. After sterilization, additional seals are provided to hermetically seal each individual cavity containing a medical device, thereby forming individually hermetically sealed secondary foil packages. The multiple package is then separated into individual hermetically sealed medical device packages and the vent is cut away as scrap. The use of this vented package eliminates the need for aseptic handling and processing.

The manufacturing of such foil packages having central vents requires that an additional step be performed which was not necessary in the prior art processes. That step is the mounting of the gas pervious vent to one of the two foil members, which make up the foil pouch. This vent must be carefully mounted so that there is no gas leakage about the periphery of the vent when it is mounted and sealed to an opening in foil member.

Accordingly, there is a need in this art for a novel manufacturing process for manufacturing foil packages for multiple medical devices having gas pervious vents.

DISCLOSURE OF THE INVENTION

Therefore, it is an object of the present invention to provide a process for manufacturing foil packages having gas permeable vents which can be automated.

It is a further object of the present invention to provide a method for manufacturing foil packages having gas pervious vents which provides for the mounting of a gas pervious membrane to a vent opening in the package in such a way to assure that the membrane is sealed so that the only pathway for gas into the package is through the membrane.

Accordingly, a process for manufacturing a foil package having a gas permeable vent is disclosed. The process consists of first providing an upper foil member and a lower foil member. The upper and lower foil members each have a top and a bottom. Next a vent opening is cut or punched into the upper foil member. The vent opening has a periphery and is preferably rectangulary shaped. Then a biobarrier member is provided and mounted to the top or the bottom of the upper foil member such that the biobarrier member is sealed about the periphery of the vent opening, thereby forming a gas tight seal about the periphery of the vent opening. Next, the integrity of the peripheral seal is vacuum leak tested and the integrity of the biobarrier membrane is vacuum leak tested. Then, at least two cavities are formed in the bottom of the lower foil member. Then, a medical device is loaded into each cavity. Next, the upper foil member is placed onto the lower foil member such that the bottom of the upper foil member is in contact with the bottom of the lower member, and the peripheries of each member are in substantial alignment. Then, the bottom of the upper member is sealed to the bottom of the lower member to form an outer peripheral seal and side seals between the cavities, thereby forming a manifold wherein the manifold is in gaseous communication with the vent.

Another aspect of the present invention is the above-described process additionally comprising steps wherein the package is subjected to an ethylene gas sterilization process.

The foregoing and other features and advantages of the present invention will become more apparent from the following description and accompanying drawings.

DESCRIPTION OF THE PREFERRED EMBODIMENT

Figure 1:
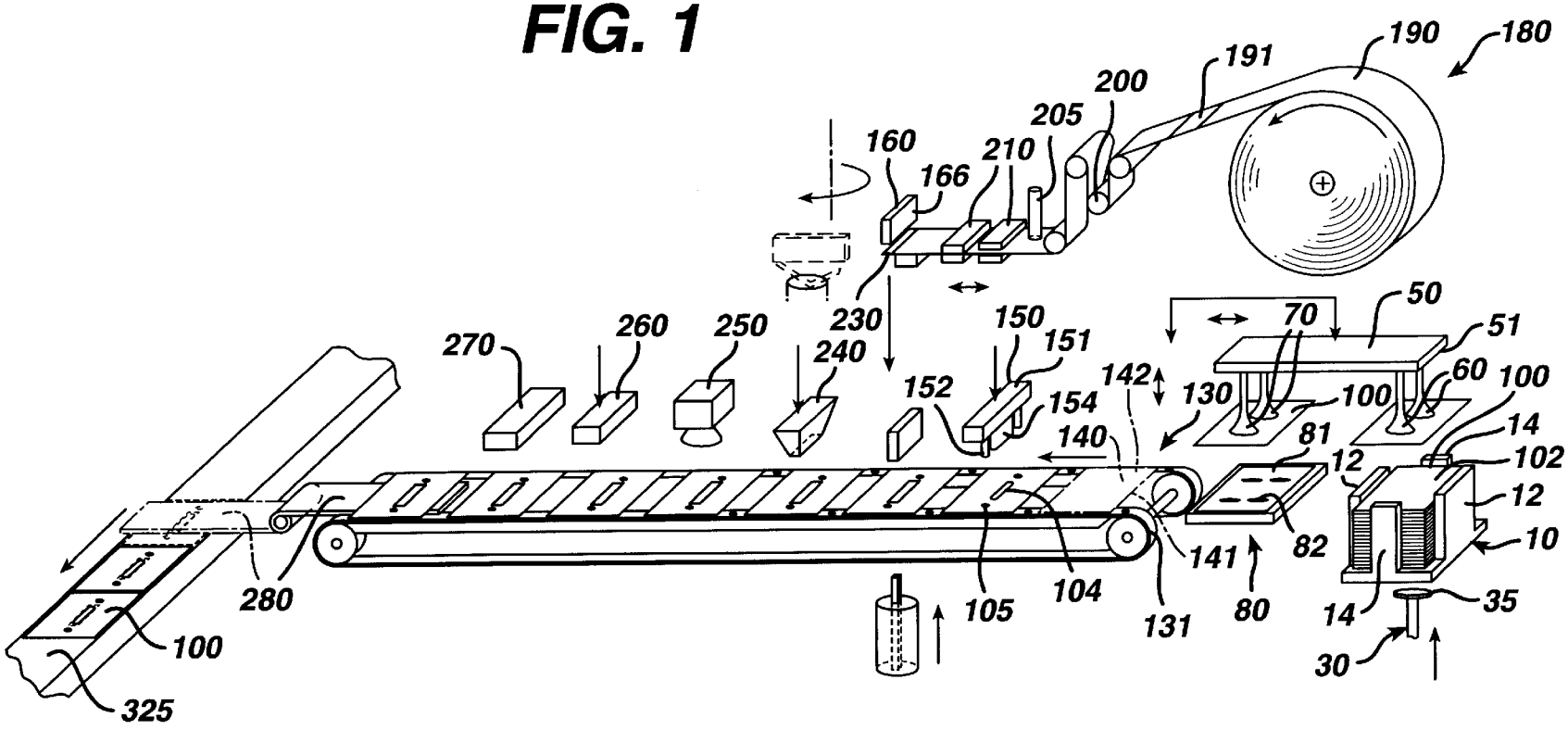
FIG. 1 is a schematic diagram of the vent application process of the present invention.

The term "gas" as used herein is defined to have its customary meaning and to further include vapors such as water vapor. The terms "gas impervious" and "gas impermeable" as used herein are defined to mean impenetrable by gases and pathogens. The terms "gas permeable" and "gas pervious" as used herein are defined to mean penetrable by gases but not pathogens. The term "microbial barrier" as used herein is defined to mean a barrier which is gas permeable or pervious and impermeable by, or impervious to, pathogens.

The materials useful for constructing the packages of the present invention include conventional metal foil products often referred to as heat-sealable foils. The heat-sealable foils are typically a laminate of one or more layers of thermoplastic resins such as polyethylene, or other polyolefins or equivalent polymeric materials coated onto a metal foil substrate, such as aluminum. The application of heat to specific sections of such a foil laminate will cause the polymeric coating to melt and thereby fuse with or into a similarly heat treated portion of a polymeric film on another piece of foil laminate. These types of foil materials are disclosed in U.S. Pat. No. 3,815,315 which is incorporated by reference. Another type of foil laminate which may be utilized is a foil laminate referred to in this art as a peelable foil. The peelable foil laminate similarly utilizes a foil metal substrate, such as aluminum, to which one or more polymeric coating has been applied. The inner polymeric coating is similarly heat sensitive and melts to fuse with the polymeric coating on another piece of the metal foil thereby forming a heat seal. The bond strength between the fused coating material and the foil metal substrates is such that the two layers may be separated by pulling apart the fused laminates thereby causing one or both of the polymeric layers to become removed from a metal substrate. Examples of such peelable foil packaging and substrates are disclosed in U.S. Pat. No. 5,623,810, which is incorporated by reference. If desired, conventional non-metallic polymer films in addition to metal foil may be used to form the packages of the present invention. The films are polymeric and include conventional polyolefins, polyesters, acrylics and the like combinations thereof and laminates. The polymeric films will be substantially gas impermeable and may be coated with conventional coatings, for example mineral coatings which decrease or reduce gas intrusion. The packages of the present invention may also be constructed of a combination of polymer and metal foils.

The microbial membranes useful in the packages of the present invention include conventional gas permeable microbial membranes such as TYVEK® spun polymeric material (polyethylene), paper, polymer films and the like and equivalents thereof.

The types of medical products which may be packaged in the packages of the present invention include any types of absorbable and non-absorbable medical devices, including sutures, tissue fasteners such as tacks, meshes, bone pins, suture anchors, bone screws, staples, and the like. Preferably the medical devices will be individually packaged in primary packages prior to packaging in the outer packages of the present invention. It is particularly preferred to use the outer packages of the present invention for suture packages. The absorbable medical devices are typically made from generally known, conventional absorbable/resorbable polymers such as glycolide, lactide, co-polymers of glycolide or mixtures of polymers such as polydioxanone, polycaprolactone and the like and equivalents thereof. It is known that if medical devices made from these absorbable polymers come into contact with water vapor prior to the time that they are to be used, they may tend to rapidly deteriorate and lose their strength. In particular, the desirable property of in-vivo tensile strength retention for sutures will be rapidly lost if the products are exposed to moisture for any significant period of time prior to use. In addition, the products are also sensitive to radiation and heat. Accordingly, as mentioned previously, it is preferred to sterilize such absorbable polymeric medical devices using conventional sterilant gases, in particular ethylene oxide gas.

The process of the present invention is illustrated in FIG. 1. As seen in FIG. 1, upper foil member storage hopper 10 contains a stack of pre-cut upper foil members 100. The foil members 100 are seen to have top sides 101, bottom sides 102 and peripheral edges or sides 108. The hopper 10 is removable from the elevator support mechanism 30 having hopper engagement platform 35. Support mechanism 30 is preferably controlled by a servo motor such that the hopper 10 moves upward as the stack of foil members 100 is depleted to provide the top of the stack of foil 100 at a constant height. The hopper 10 is seen to have opposed side containment members 12 and 14 which are spaced such that the upper foil members 100 are appropriately contained within the magazine to allow removal without damaging the edges 108 of the upper foil members 100.

Transfer bar 50 is seen to have suction cup members 60 and 70 extending from the bottom side 51. The transfer bar 50 is seen to move in an oscillating manner between vacuum belt 130 and the hopper 10 to move upper foil members 100 sequentially from hopper 10 to singulation plate 80 and then onto plate member 140 of the belt 130. The transfer bar 50 operates in the following manner. Initially, in its first position suction members 60 are positioned over the top of hopper 20 and suction cup members 70 are positioned over transfer plate member 80. The suction cup members 60 are conventional elastomeric suction cups having a central internal vacuum pathway connected to a conventional source of vacuum, such as a vacuum pump. The suction cup members 70 are structurally identical to members 60 and are similarly connected to a source of vacuum. Initially during the first cycle, suction cup members 60 pick up a sheet of upper foil member 100 by engaging the inner side 101 (during the initial cycle, cup members 70 do not engage a foil member 100). The bar 50 is then moved up vertically and translated horizontally such that the suction cup members 60 are situated over the singulation plate member 80. Singulation plate member 80 is seen to be a rectangularly shaped plate having a top surface 81 and a plurality of vacuum ports 82 contained therein. Ports 82 are connected to a conventional source of vacuum. At this point in the cycle, the suction cups 70 are then simultaneously in a position over the end 131 of the vacuum belt 130 and positioned over a plate member 140. The bar 50 is then moved downwardly toward the top surface 81 of the singulation plate 80 such that the bottom of the upper foil member 100 is engaged onto the top surface 81 by the vacuum from the vacuum ports 82, while the vacuum to cups 60 is simultaneously disengaged. At this point, the suction cups 70 are positioned over a plate member 140 of belt 130. Then for all subsequent cycle, the bar 50 is cycled back to its starting position and moved downwardly so that suction cups 60 engage another sheet 100 from the hopper 10 while suction cups 70 engage a sheet 100 from the singulation plate 80. Next, the bar is moved up and cycled forward such that the suction cups 70 are over the end 131 of the vacuum belt 130 over a plate member 140 and the cups 60 and a foil member 100 are over the singulation plate 80. Then the bar 50 is moved is downwardly and the vacuum is restricted to cups 70 and 60 such that the top sides 101 of sheets 100 are engaged on the top surface 142 of plate member 140 by the vacuum belt 130 and the top surface 81 of the singulation plate 80, respectively.

Figure 2:
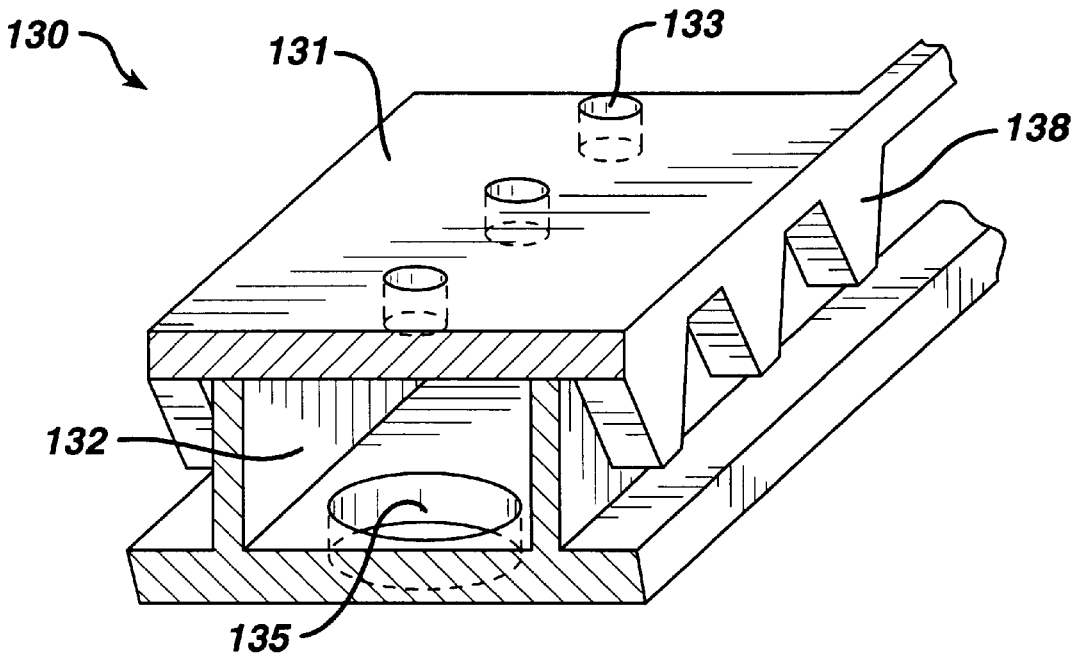
FIG. 2 is a schematic of a cross-sectional view of the vacuum belt used in the process of the present invention.

Referring now also to FIG. 2, The belt 130 is seen to be formed from a pair of opposed continuous members 131 having central interior cavity 132. Continuous members 131 are seen to be connected by opposed side walls 133. Vacuum holes 133 on the surface of member 131 are in communication with central cavity 132. On the bottom side of member 131 are the main vacuum supply holes 135 in communication with central cavity 132. On the side of the members 131 are the drive teeth 138. Members 131 are joined by rectangular plate members 140. The upper members 100 are maintained on the top surfaces 142 of plate members 140 as seen in FIG. 1 by application of vacuum through belt 130.

Referring again to FIG. 1, after an upper foil member 100 has been transferred to plate member 140, the vacuum belt 130 then moves the upper foil member sheet 100 (which is maintained on the plate 140) to the hole and slot punching station. The hole slot and punching station consists of a conventional press and die punch. Die punch 150 is seen to have rectangular support member 151. The press (which is not shown) is a conventional press or equivalent thereof such as a pneumatic or hydraulic punch press that provides sufficient force to effectively allow the dies to cut through the foil member 100.

Circular dies 152 having cutting peripheries and rectangular die 154 having a cutting periphery extend downwardly from the bottom of member 151 to cut out the vent slot 104 and registration holes 105 in foil member 100.

Figure 3:
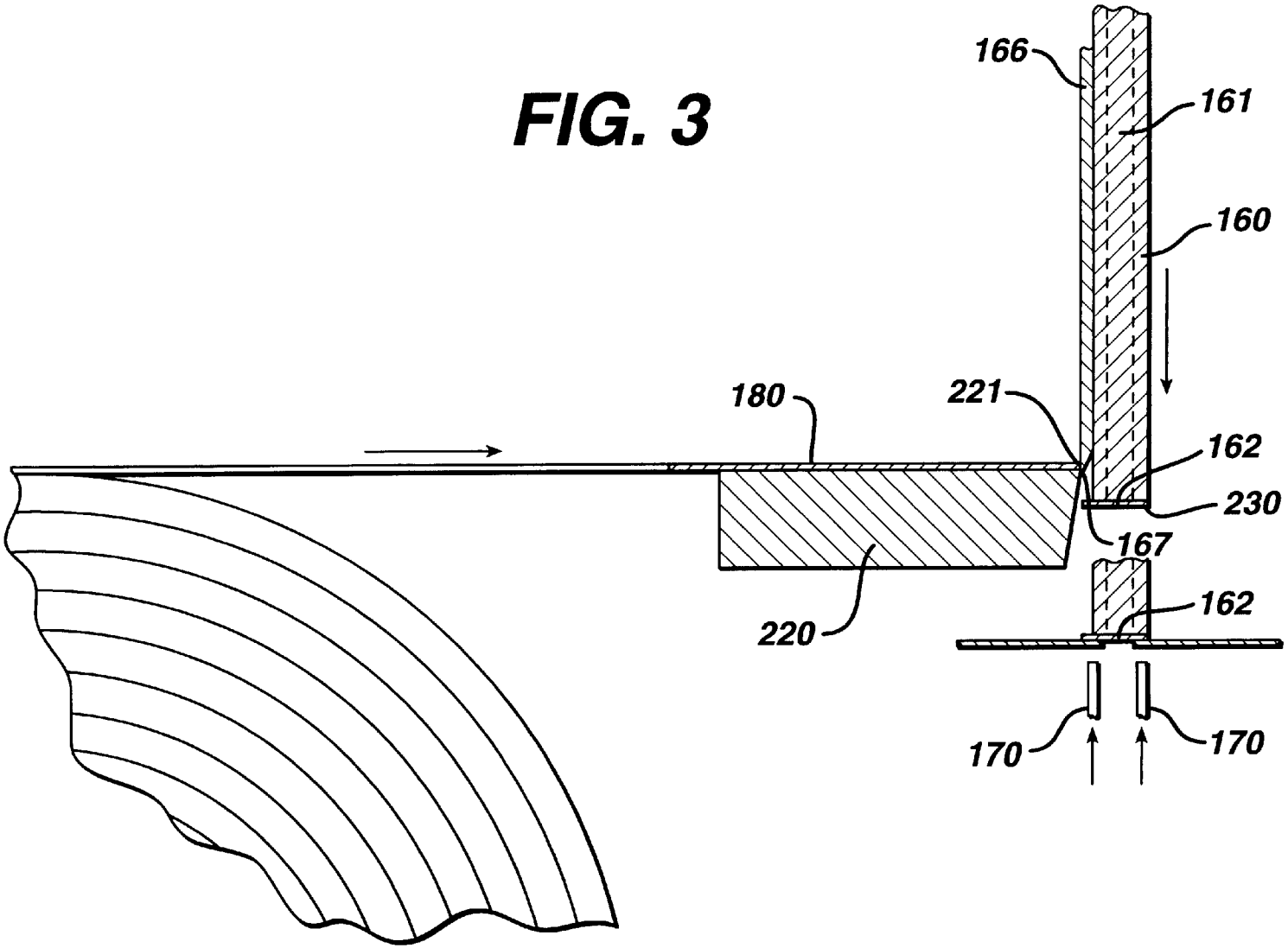
FIG. 3 is a side view of a schematic of the biobarrier cut-off and transfer station.

Next, the upper foil member 100 having vent slot 104 and holes 105 is moved to the gas permeable barrier application station. At the barrier application station, a vertically movable member 160 is seen to move the barrier member 230 from the cutting station and position it onto the inner or bottom side 102 of the foil member 100 such that the vent opening is completely covered. The member 160 is also seen to cut the biobarrier member 230 from rolled stock 190 at the biobarrier cutting station. The biobarrier member 230 is prepared by initially feeding biobarrier membrane stock 190 contained on a roll 180 through a plurality of idler roll members 200 and then to a pair of conventional gripper members 210. The gripper members 210 feed the membrane stock 190 to the stock cutting station wherein the vent placement member 160 is located. As the stock 190 is fed to the cutting station, it is scanned by optical scanner 205. Optical scanner 205 is a conventional optical scanner that is set up to look for splices 191 in roll stock 190. Spliced sections 191 are discarded as scrap at the cutting station by rotating member 160 (using a conventional mechanical rotation system not shown) and depositing spliced sections in a scrap bin; member 160 is then rotated back into position. As seen in FIG. 3, member 160 has central interior chamber 161 that is in communication with bottom engagement opening 162. Cutter 166 having cutting edge 167 cuts the stock 190 against cutting block 220 into biobarrier members 230 by cutting against cutting block edge 221. The member 160 engages the cut biobarrier member 230 by having a sufficient interior vacuum to maintain the member 230 against the engagement member 162. Member 160 then moves the biobarrier member 230 down onto the inner side 102 of foil member 100 and positioned over vent 104. An extendable heated post member 170 then extends upwardly to the bottom 142 of the plate 140 to cause the biobarrier to be tack sealed to the inner side 102 of the member 100 about vent opening 104.

The belt 130 then moves the member 100 and biobarrier member 230 to the high integrity seal station. At the high integrity seal station as seen in FIG. 1, the tacked biobarrier member 230 is sealed by conventional electrically heated die 240 which is pressed about the periphery of biobarrier 230 causing the biobarrier 230 to sealed about the periphery of vent 104. The belt 130 then moves the member 100 to the inspection station where an automated conventional vision system 250 compares the location of the microbial barrier strip 230 to the reference holes 105, and is identified if out of position and eventually removed as scrap by a conventional computer control. Next, the belt 130 moves the member 100 to the seal integrity testing station as seen in FIG. 4A. At the seal integrity testing station, tool 260 having internal cavity 265 is pressed against the bottom side 102 of foil member 100 and is pressed against the top side 141 of plate member 140 about the biobarrier member 230 in such a manner that the biobarrier is sealed by the tool 260. Then, a source of vacuum 266 is connected to the cavity 265 for a period of time to achieve a particular vacuum level. Next, the vacuum source is closed off from the cavity and the length of time for the vacuum in the cavity to decay is measured. Based upon an empirical correlation of rate of decay of the vacuum, the seal is determined to either have integrity or to have a leak by comparison with a standard, and identified as a "leaker" and eventually removed as scrap.

Figure 4B:
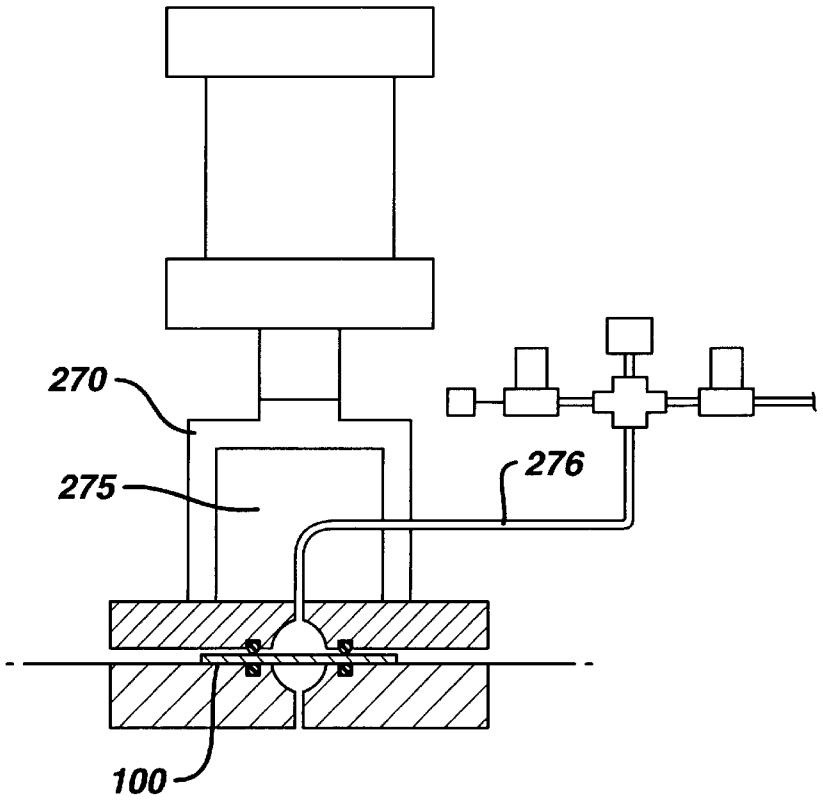
FIG. 4B is a side view of the porosity testing station.
Figure 4A:
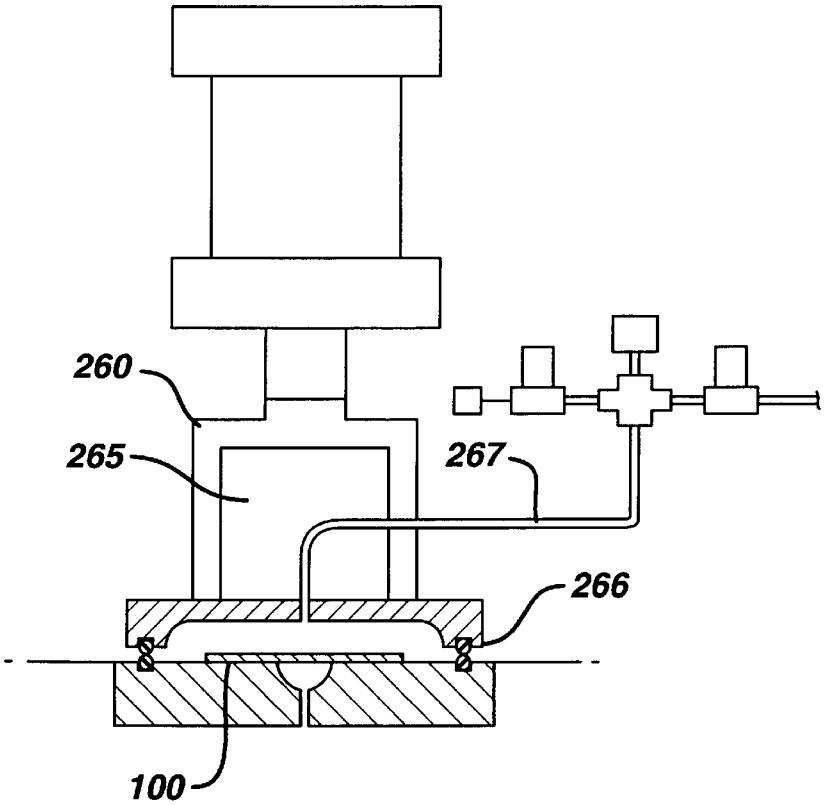
FIG. 4A is a side view of schematic of the leak seal testing station.

Next, the foil member 100 is moved by the belt 130 to the permeable biobarrier membrane test station as seen in FIG. 4B. At this station, the tool 270, having cavity 275 and vacuum source 276 similar to the tool 260 is used to test the membrane integrity in a similar manner using a vacuum decay test, which correlates rate of decay of vacuum to an empirically determined standard. Once again, a conventional computer controlled system is used to identify the defect and remove the member 100 having a defective membrane as scrap. Next, the belt moves the membrane 100 to the transfer station, where the foil members 100 having biobarriers 230 are moved to conveyor belt 325. A pivotally hinged vacuum plate 280 is used to move the upper member 100 to the belt 325 while inverting it 180° so that the bottom 102 of the member 100 is on the top of and in substantial registration with a lower foil member 110 resting on top of belt 325, and top 101 is now exposed. At this point the packages 90 of sutures have been loaded into cavities 120 in foil member 110, and the assembled package 700 is sent to a sealing station for completion of peripheral and interior seals.

Figure 5:
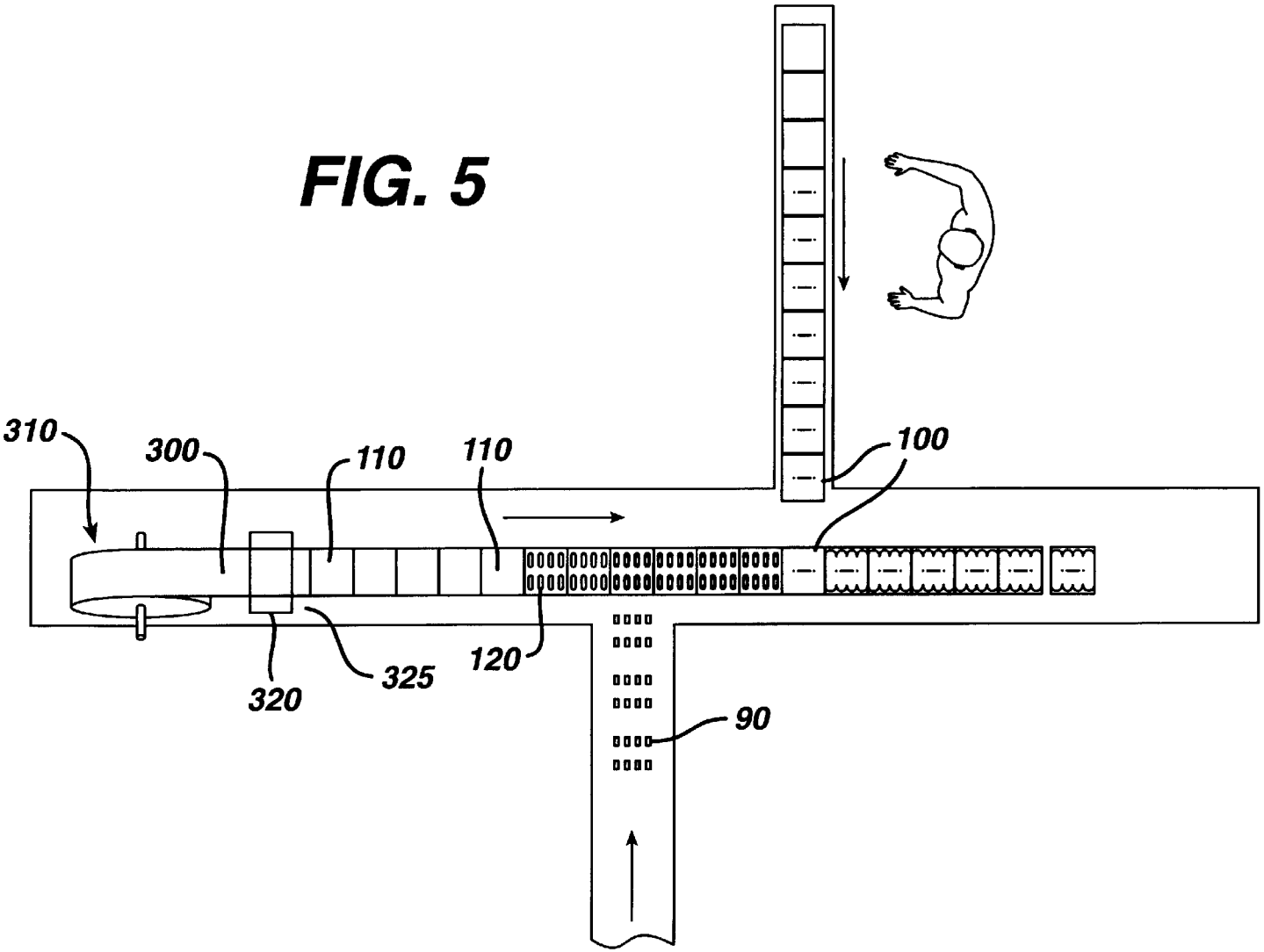
FIG. 5 is a schematic of the packaging process of the present invention illustrating the forming and loading of the bottom member as well as the formation n of the finished package.
Figure 6:
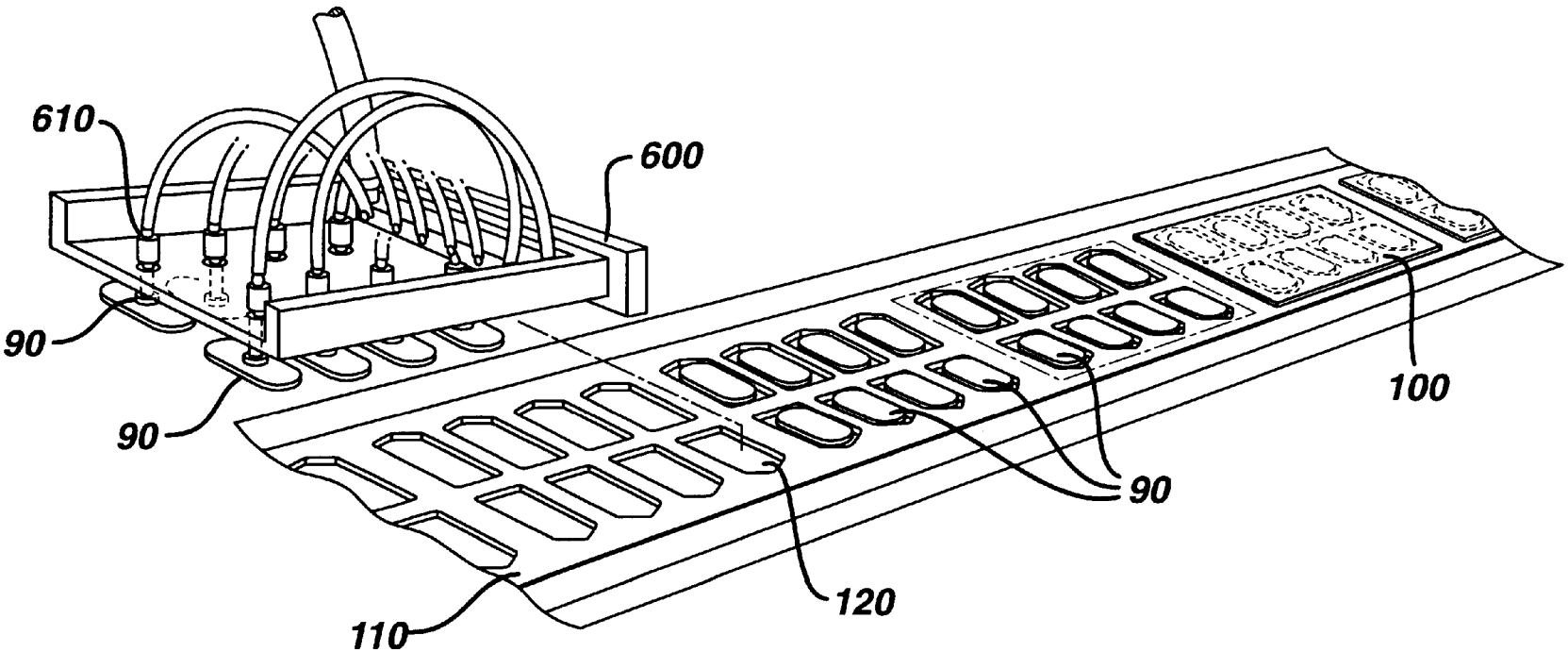
FIG. 6 is a schematic diagram of a section of the cavity forming, package loading, and top and bottom foil member assembly steps of the process of the present invention.
Figure 7:
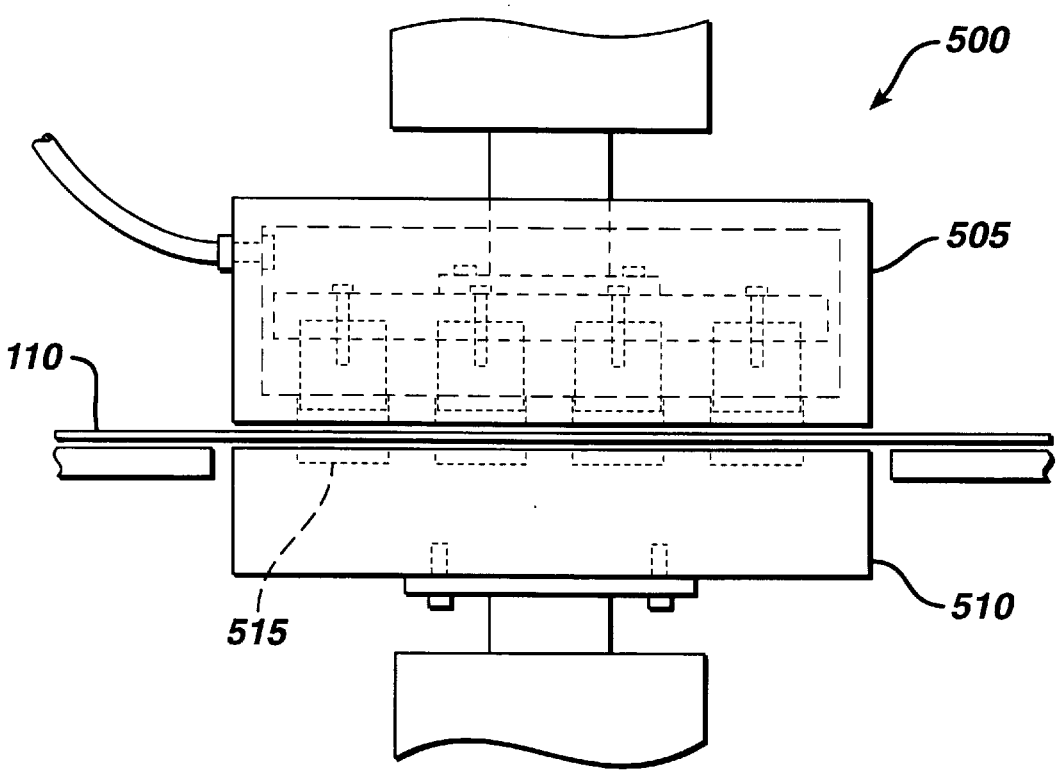
FIG. 7 is a schematic of a cavity forming device useful in the process of the present invention.

A partial schematic packaging process of the present invention with regard to forming the bottom foil member 110 and then mating it to upper foil member 100 is seen in FIG. 5. Foil stock 300 on roll 310 is fed in a conventional manner to a conventional cutting apparatus 320. The stock 300 is cut into bottom members 110 having top sides 111 and bottom sides 112. The bottom members 110 are placed upon endless conveyor belt member 325 and individually fed into a conventional multi-cavity foil apparatus 500 as seen in FIG. 7. Cavities 120, having roughly the shape of suture packages 90, are then formed in the inner side 112 of bottom foil member 110. Then, as seen in FIG. 6, the medical devices, such as suture packages 90, are loaded into the cavities 120 of a bottom foil member 110 using a conventional vacuum placement rack 600 such that one suture package 90 is loaded into each cavity 120. Then, pivoting vacuum member 280 places a member 100 having vent 104 on top of a member 110 such that the foil members 110 and 100 are aligned to form unsealed package 700. The members 100 and 110 are then moved to a primary peripheral seal station where a conventionally heated die forms the peripheral seals and secondary seals to form sealed package 700.

Figure 7A:
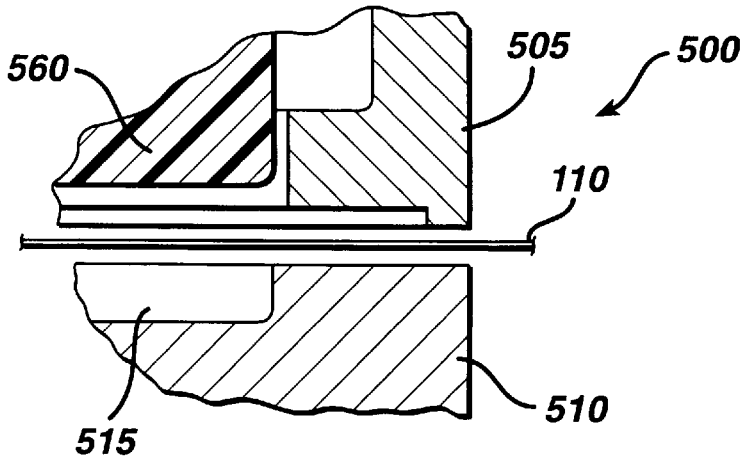
FIG. 7A is a partial cross-sectional view of the apparatus of FIG. 7.

Referring now to FIG. 7 and FIG. 7A, cavity-forming apparatus 500 is seen to have upper frame 505 and lower frame 510. Lower frame 510 is seen to have a plurality of cavities 515 therein. Bottom foil members 110 are seen to be placed between frames 505 and 515 of apparatus 500. Initially a jet of compressed air through nozzles 530 is used to deform sections of the foil member 110 into the cavities 120. Then, frame 505 containing plug members 560 is moved downward with respect to stationery frame 510 such that the plug members 560 engage the foil member 110 to further conform the foil more precisely to the shape of the cavities 515. Next, as seen in FIG. 6, frame 600 having manifolded vacuum pick-up units 610, is utilized to place medical devices such as packaged needles and sutures 90 into the cavities 120 of each foil member 110.

Figure 8:
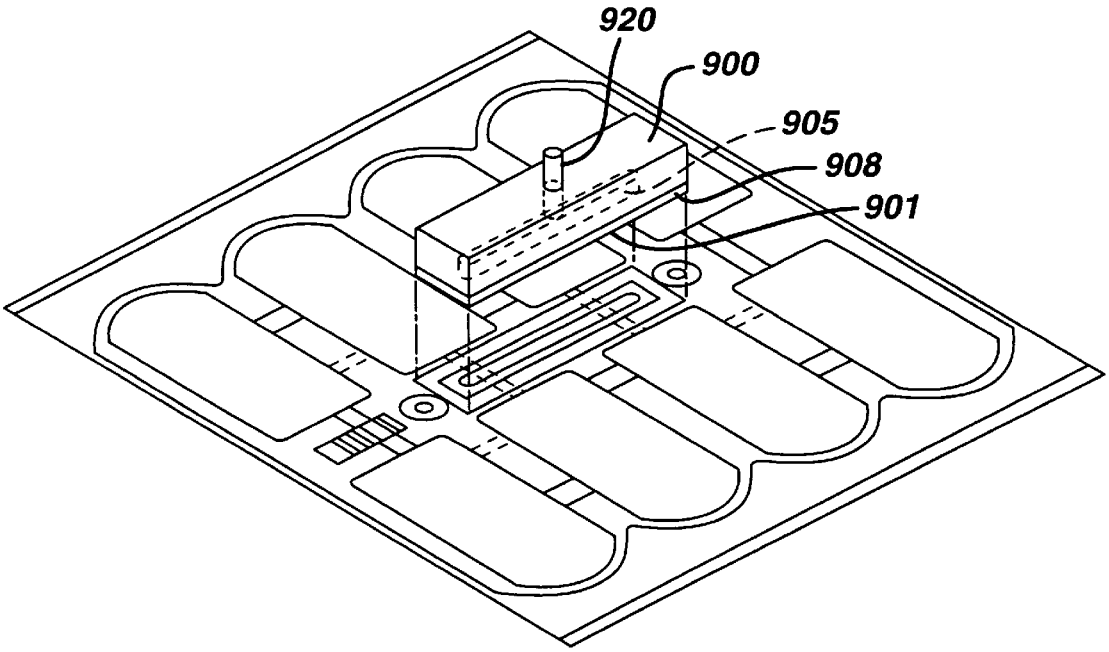
FIG. 8 is a perspective view of an air evacuation device useful in the practice of the packaging process of the present invention.

As seen in FIG. 8, the process may include an optional step of evacuating air from the packages 700 through vent 104. To do this, vacuum evacuation tool 900 having cavity 905 in communication with vacuum source 920 is placed over vent 105. Tool 900 has sealing gasket 908 mounted to the bottom 901 such that it seals off the vent 105 from the ambient atmosphere. The package 700 will tend to collapse after application of vacuum and remain in a compressed configuration after the vacuum is removed.

Figure 9:
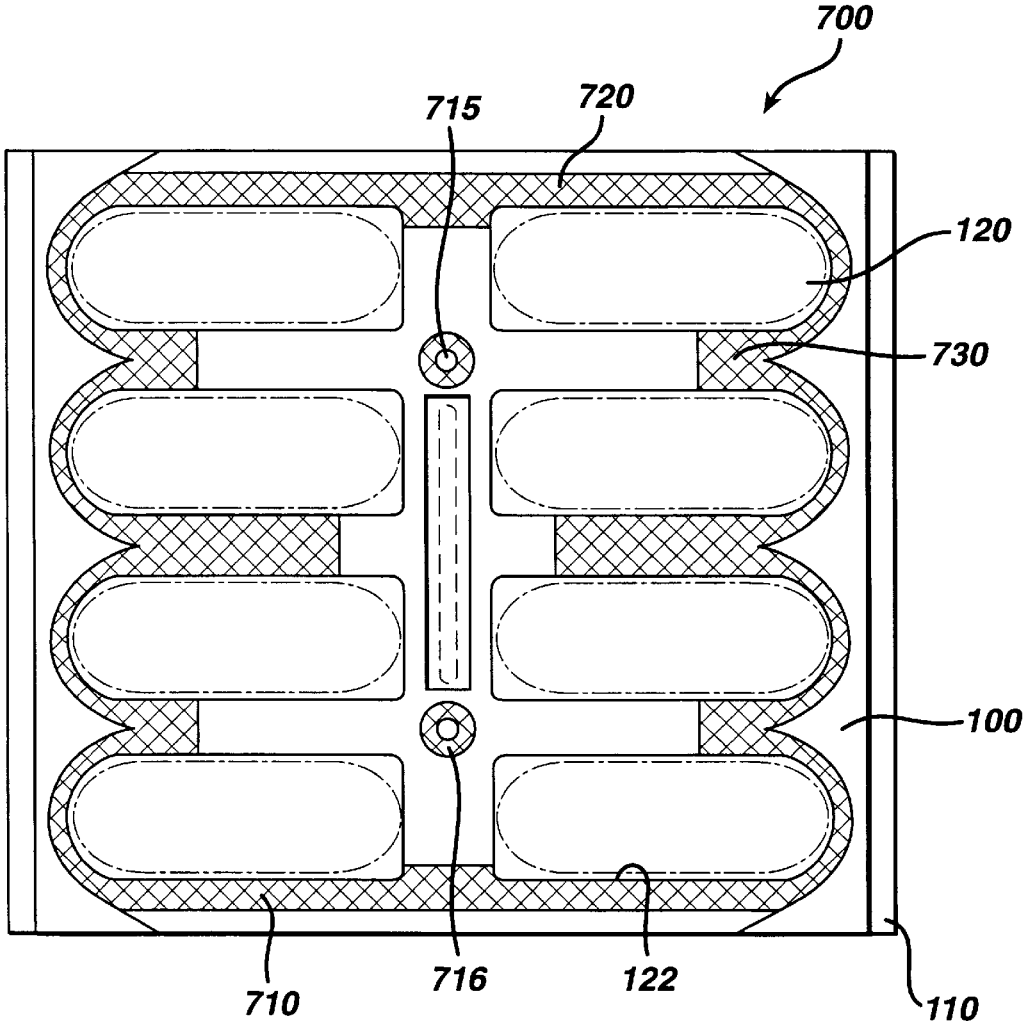
FIG. 9 illustrates a package manufactured by the process of the present invention having a peripheral seal and side seals prior to sterilization.
Figure 10:
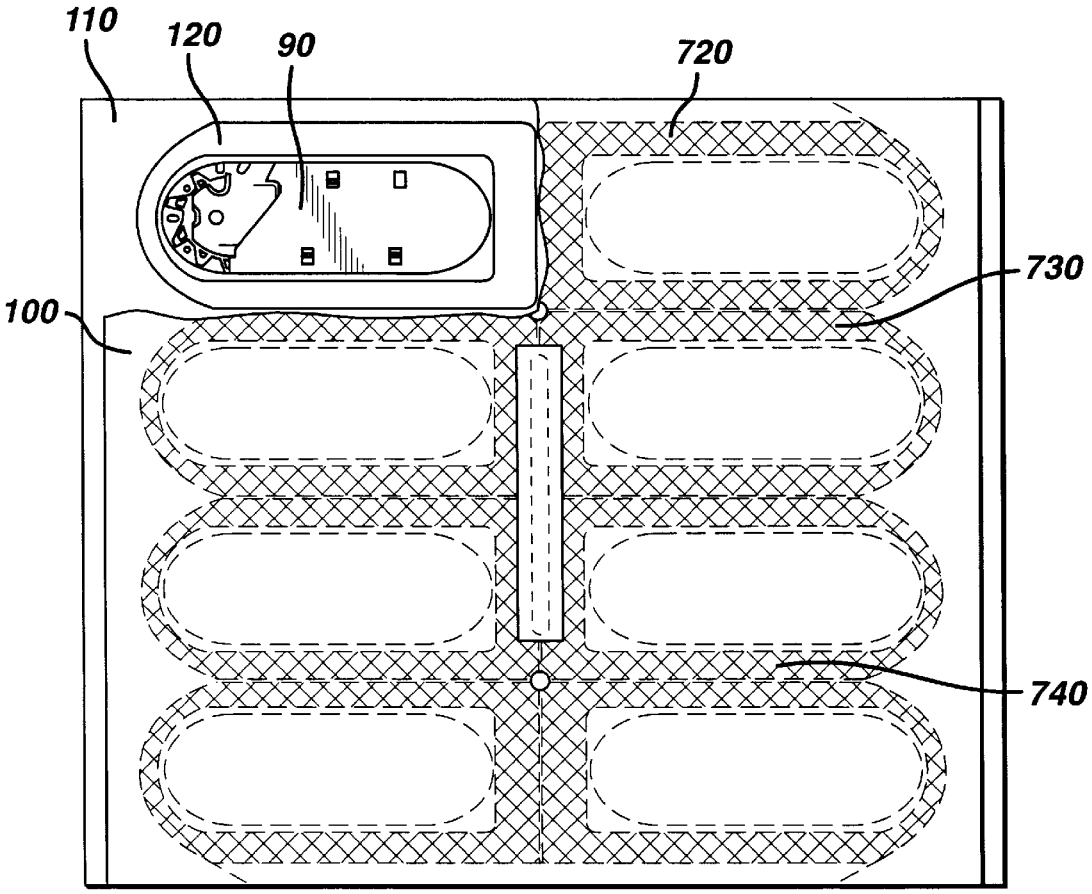
FIG. 10 illustrates the package of FIG. 9 manufactured by the process of the present invention after sterilization and having secondary seals providing for hermetically sealed cavities.

Referring to FIGS. 9 and 10, a multi-cavity foil package 700 made by the process of the present invention is illustrated. The package is seen to have first or top foil member 100 The package 700 is also seen to have second foil member 110. The foil member 110 is seen to have a plurality of cavities 120 formed therein. The cavities 120 are seen to have sides 122, opposed ends 124, and bottom 126. The cavities 120 are formed as described previously above in a conventional manner using, for example, conventional dies and plugs and/or compressed gas, for forming the foil into the shapes as defined by the cavities. The cavities 120 preferably have an oval-type shape as illustrated, however, other types of configurations are also possible depending on the size and shape of the medical device and/or primary package to be packaged. These configurations include circular configurations, square, rectangular, polygonal, and combinations thereof. The foil member 100 is seen to have vent opening 104. Mounted to the vent opening 104 is the gas permeable microbial membrane 230. The vent opening 105 is preferably centrally located. The gas permeable microbial membrane 230 will typically be heat fused to the inner coating of the bottom of top member 100 Membrane 230 may also be mounted to outer side of member 100.

Membrane 230 may have any configuration including rectangular, square, circular and the like.

The package 700 is seen to have peripheral seal 710 and side seals 730. The peripheral seal 720 may be configured to extend parallel to the sides of the planar members 100 and 110 or may be contoured to follow the shapes of cavities 90 or combinations thereof. For example, the peripheral seal 720 is seen to follow the configuration of the ends 124 of cavity 120. The side seals 730 are seen to extend from peripheral seal 720, partially between, and adjacent to the cavities 120. The package 700 is also seen to have the pilot holes 715 adjacent to opening 104. Pilot holes 715 extend through both foil member 100 (and are coextensive with holes 105) and foil member 110 and are used to align both members together as well as to align the top and bottom foil members and package 700 in various pieces of processing machinery. The area surrounding holes 715 is sealed by seals 716. The combination of the peripheral seal 720 and the side seals 730 creates a plurality of channels or a manifold passageway 780 from vent 104 through barrier member 230 to the cavities 120. This manifold passageway allows sterilant gas to enter vent 104 and travel via the manifolded channels to the cavities 120 thereby allowing it to come into contact with the packages 90 or any other medical devices contained in the cavities 120, and also allows for the evacuation or removal of the sterilant gas from the interior of package 700 as well as for the removal of other conventional gases and vapors including ambient air, nitrogen, gaseous diluents, water vapor and the like.

Figure 11:
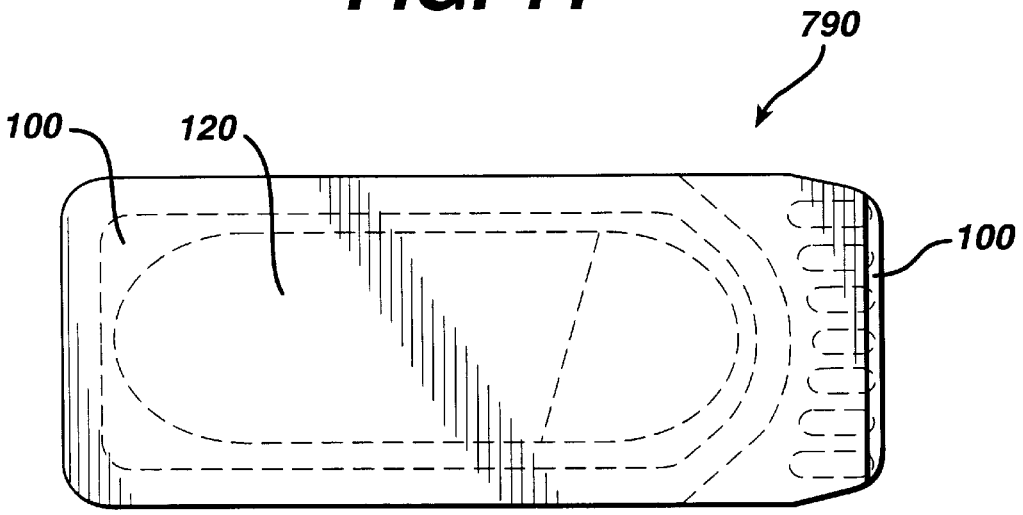
FIG. 11 illustrates an individual hermetically sealed unit package formed from the package of FIG. 10.

Referring now to FIG. 10, the interior seals 740 are illustrated. Seals 740 are processed into the package 700 after sterilization along with the optional grooves 745. Grooves 745 are believed to eliminate wrinkles in the foil planar members. The side seals 730 are simultaneously extended to interior seals 740 so that each cavity 120 is completely sealed off such that the cavities 120 are each maintained in a hermetically sealed gas impermeable package. This is typically done after sterilization as will be discussed below. The package 700 is then separated into unit packages 790 as seen in FIG. 11 by die cutting the individual packages 790 from the package 700 such that each unitary package 790 contains a cavity 120 surrounded by a gas impermeable seal. The vent 104 and gas permeable material 230 along with scrap are cut away and do not remain with the package 700 after the unit packages 790 have been cut away.

It will be appreciated by those skilled in the art that the dimensions of the packages of the present invention along with the cavities and compartments will vary in accordance with the size of the medical devices to be packaged along with the types of packaging material and the types of packaging equipment which are utilized.

A preferred embodiment of an ethylene oxide sterilization process useful for the packages 700 of the present invention is described below, although any conventional ethylene oxide gas process my be used which is sufficient to effectively sterilize a packaged medical device. Those skilled in the art will appreciate that although ethylene oxide gas is a preferred sterilant gas, any sterilant gas may be used with the packages 10 of the present invention. After the package 700 has been formed with the peripheral seal 720 and side seals 730 to form the manifold 800, the packages 700 are then placed into a conventional ethylene oxide sterilization unit. Prior to the start of the cycle, the sterilizer is heated to an internal temperature of about 25° C. Next, a vacuum is drawn on the sterilization unit to achieve a vacuum of approximately 1.8 to 6.0 kpa. Steam is then injected to provide a source of water vapor for the product to be sterilized. The packages 700 are exposed to water vapor in the sterilizer for a period of time of about 60 minutes to about 90 minutes. Following the humidification portion of the cycle, the sterilizer is pressurized by the introduction of dry nitrogen gas to the pressure of between about 46 and 48 kPa. When the desired pressure is reached, pure ethylene oxide is introduced into the sterilization unit until the pressure reaches about 95 kpa. The ethylene oxide sterilant gas is maintained in the sterilization unit for about 360 to about 600 minutes for surgical sutures. The time required to sterilize other medical devices may vary depending on the type of product and the packaging. The ethylene oxide sterilant gas is then evacuated from the sterilization unit and the vessel is maintained under vacuum at a pressure of approximately 0.07 kpa for approximately two hours in order to remove residual moisture and ethylene oxide from the sterilized sutures. The pressure in the sterilizer is then returned to atmospheric pressure at a temperature of about 21° C. to about 32° C. The product in the packages 700 is then dried by exposing the packages 700 to dry nitrogen and vacuum over a number of cycles sufficient to effectively remove residual moisture and water vapor from the product and packages. The packages are then removed from the sterilizer and may be stored in a humidity controlled storage area prior to processing into unitary packages. It is interesting to note that the storage of the multi-cavity packages prior to processing into unitary packages does not have to be in an aseptic environment, only humidity controlled.

In using the outer packages and processes of the present invention for multi-cavity absorbable suture or medical device packaging, it is now possible to gas sterilize the contents of each cavity of a multicavity foil and form hermetically sealed sterile unit packages without the need for a separate aseptic sealing step. The use of a central vent eliminates the need for aseptic processing thereby greatly improving the efficiency of the process and minimizing or eliminating the efforts required to prevent contamination during aseptic processing. The process of the present invention allows for an automated seal application step and for automatic testing of both seal and biobarrier integrity.

Although this invention has been shown and described with respect to detailed embodiments thereof, it will be understood by those skilled in the art that various changes in form and detail thereof may be made without departing from the spirit and scope of the claimed invention.

We claim:

1. A method of manufacturing a vented foil package for medical devices, said process comprising:

providing a flat foil upper member, said member having a top and a bottom;

punching a vent opening into the foil upper member, said vent opening having a periphery;

providing a biobarrier member;

mounting the biobarrier member to the bottom of the foil upper member such that the biobarrier member is sealed about the periphery of the vent opening;

vacuum leak testing the integrity of the seal on the biobarrier membrane;

vacuum leak testing the integrity of the biobarrier membrane;

providing a lower foil member, said lower member having a top and a bottom;

forming at least two cavities in the lower member;

loading a medical device into each cavity;

placing the upper foil member onto the lower foil member such that the bottom of the upper foil member is in contact with the top of the lower member; and sealing the bottom of the upper member to the top of the lower member to form an outer peripheral seal and side seals between the cavities forming a manifold in gaseous communication with the vent.

2. The process of claim 1 additionally comprising the step of ethylene oxide sterilizing the package.

3. The package of claim 2 additionally comprising the step of providing additional seals to hermetically seal each cavity after sterilization.

4. The process of claim 3 additionally comprising the step of cutting the package into individual hermetically sealed packages.

5. The process of claim 1 further comprising the step of evacuating air from the package by placing a vacuum source adjacent to the vent after the upper and lower members are sealed.

6. A method of manufacturing a vented foil package for medical devices, said process comprising:

providing a flat foil upper member, said member having a top and a bottom;

punching a vent opening into the foil upper member, said vent opening having a periphery;

providing a biobarrier member;

mounting the biobarrier member to the bottom of the foil upper member such that the biobarrier member is sealed about the periphery of the vent opening;

vacuum leak testing the integrity of the seal on the biobarrier membrane; and, vacuum leak testing the integrity of the biobarrier membrane.

7. The process of claim 6, additionally comprising the steps of providing a bottom foil member and sealing the upper foil member to the lower foil member to form a package such that the package has a peripheral seal and internal seals, the internal seals forming channels in communication with the vent.

8. The process of claim 7, additionally comprising the step of evacuating air from the package through the vent after sealing.

* * * * *

UNITED STATES PATENT AND TRADEMARK OFFICE

CERTIFICATE OF CORRECTION

PATENT NO. : 6,021,625

DATED : February 8, 2000

INVENTOR(S) : Cerwin, Daniele, Dey, Findlay, Ivanov, Krever, Lynch, Nunez, Reinhardt, Reyhan, Szabo, Reiser, Grotehusmann, Hild and Frey It is certified that error appears in the above-identified patent and that said Letters Patent is hereby corrected as shown below:

On the title page, item [54] and Column 1:

Title: Should be: PROCESS FOR APPLYING MICROBIAL BARRIER VENT TO A FOIL PACKAGE

Signed and Sealed this

Twenty-eighth Day of November, 2000

*Attest:*

Q. TODD DICKINSON

*Attesting Officer*

*Director of Patents and Trademarks*